US010905170B2

(12) United States Patent
Fortier

(10) Patent No.: US 10,905,170 B2
(45) Date of Patent: Feb. 2, 2021

(54) MALE GARMENT

(71) Applicant: LES COLLECTIONS HIP INC., Boisbriand (CA)

(72) Inventor: Nathalie Fortier, Boisbriand (CA)

(73) Assignee: LES COLLECTIONS HIP INC.

( * ) Notice: Subject to any disclaimer, the term of this patent is extended or adjusted under 35 U.S.C. 154(b) by 346 days.

(21) Appl. No.: 15/896,178

(22) Filed: Feb. 14, 2018

(65) Prior Publication Data

US 2019/0246706 A1 Aug. 15, 2019

(51) Int. Cl.
*A41B 9/02* (2006.01)

(52) U.S. Cl.
CPC ..... *A41B 9/026* (2013.01); *A41B 2400/38* (2013.01)

(58) Field of Classification Search
CPC ..... A41B 2400/38; A41B 9/026
USPC ..... 2/403
See application file for complete search history.

(56) References Cited

U.S. PATENT DOCUMENTS

| | | | | |
|---|---|---|---|---|
| 2,138,481 | A * | 11/1938 | Chatfield | A41B 9/02 602/69 |
| 7,958,571 | B2 | 6/2011 | Kitsch et al. | |
| D735,411 | S | 8/2015 | Harris | |
| 9,375,035 | B1 * | 6/2016 | Ingels | A41B 9/02 |
| 2012/0167279 | A1 | 7/2012 | Bigney | |
| 2015/0313290 | A1 | 11/2015 | Bigney et al. | |
| 2019/0116889 | A1 * | 4/2019 | Kimel | A41B 9/023 |

FOREIGN PATENT DOCUMENTS

| | | |
|---|---|---|
| CA | 2615227 C | 1/2010 |
| CA | D133058 | 6/2010 |
| CA | D138997 | 3/2012 |
| CA | 2729368 A1 | 6/2012 |

* cited by examiner

*Primary Examiner* — Katherine M Moran
(74) *Attorney, Agent, or Firm* — Lavery, De Billy, LLP; Gwendoline Bruneau

(57) ABSTRACT

A male garment and a method of fabrication thereof, the male garment comprising a front portion and a back portion extending into leg openings at a bottom edge thereof, wherein the front portion comprises, on an inner side thereof, a left flap and a right flap crossing at a bottom thereof, at the center of the front portion.

8 Claims, 4 Drawing Sheets

MALE GARMENT

FIELD OF THE INVENTION

The present invention relates to male garments. More specifically, the present invention is concerned with a male underwear garment.

BACKGROUND OF THE INVENTION

A number of male underwear garments allowing supporting men's genitals have been developed over the years, with the aim of providing increased space and improved comfort and ease of movement.

There is still a need in the art for a male underwear garment.

SUMMARY OF THE INVENTION

More specifically, in accordance with the present invention, there is provided a male garment comprising a front portion and a back portion extending into leg openings at a bottom edge thereof, wherein the front portion comprises, on an inner side thereof, a left flap and a right flap crossing at a bottom thereof, at the center of the front portion.

There is further provided a male garment, comprising a front portion and a back portion extending into leg openings at a bottom edge thereof, wherein the front portion comprises a pouch in the center thereof, the pouch having a top opening aligned with the genitals of a user as the user inserts his legs through the leg openings, and a crossed-patterned bottom, opposite the top opening, supporting the genitals of the user when the user wears the garment.

There is further provided a method for manufacturing a male garment, comprising providing a garment body comprising a front portion and a back portion extending into leg openings; connecting a left flap to the material of the front portion, on an inner side of the front portion; and connecting a right flap to the material of the front portion, on the inner side of the front portion, so that the left and right flaps cross at a bottom thereof at a bottom edge of the front portion; thereby forming a pouch having a top opening aligned with the genitals of a user as the user inserts his legs through the leg openings, and a crossed-patterned bottom, opposite the top opening, supporting the genitals of the user when the user wears the garment.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

Figure 1:
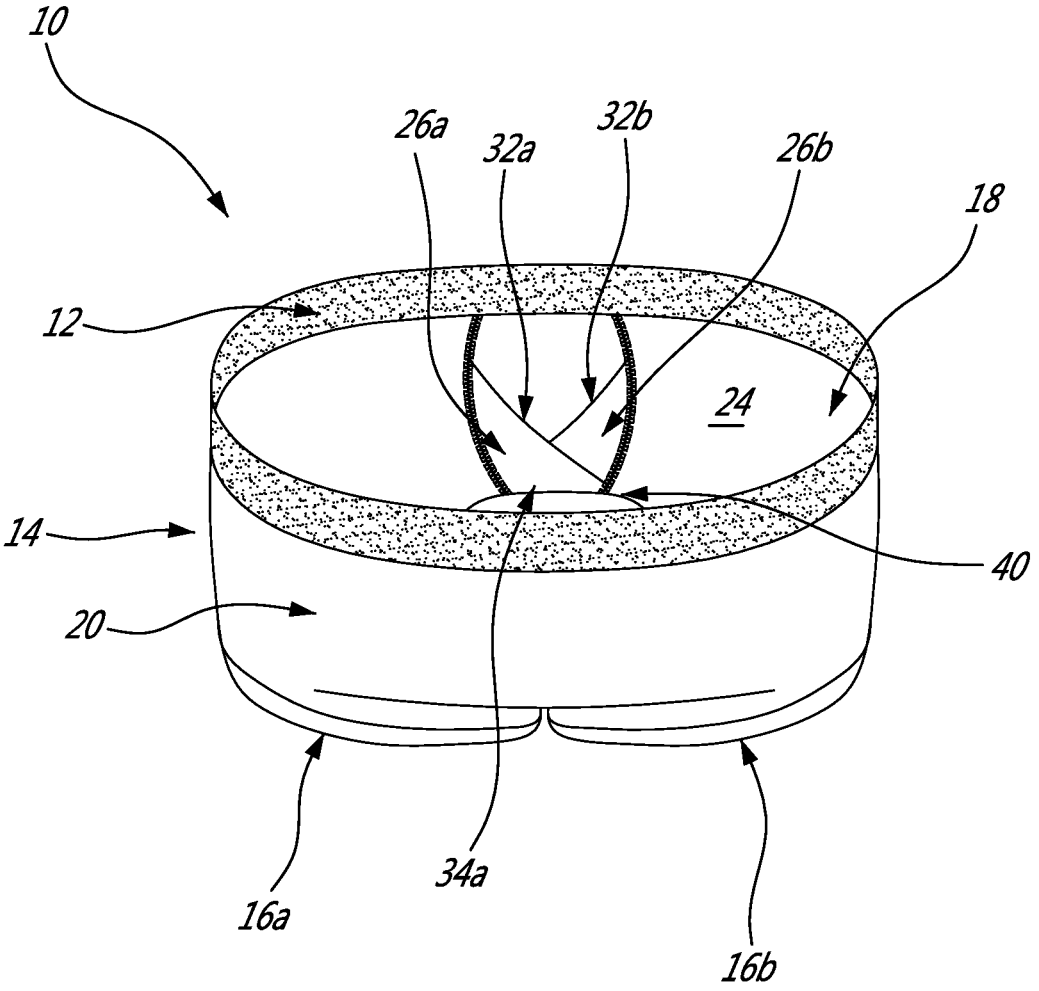
FIG. 1 is a back elevational view of a male garment according to an embodiment of the present invention.
Figure 2:
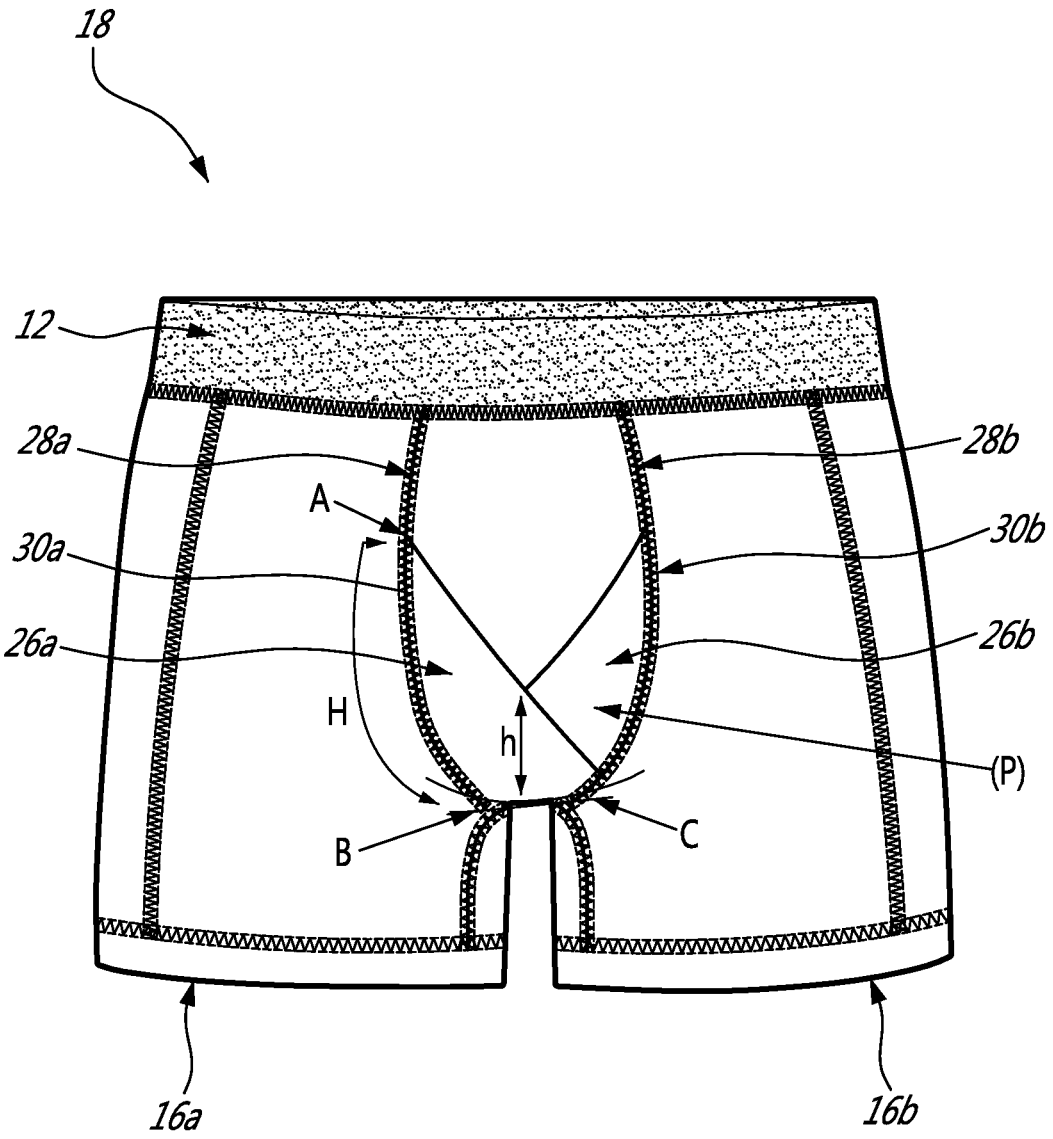
FIG. 2 shows the inside of the front portion of the male garment of FIG. 1.
Figure 3A:
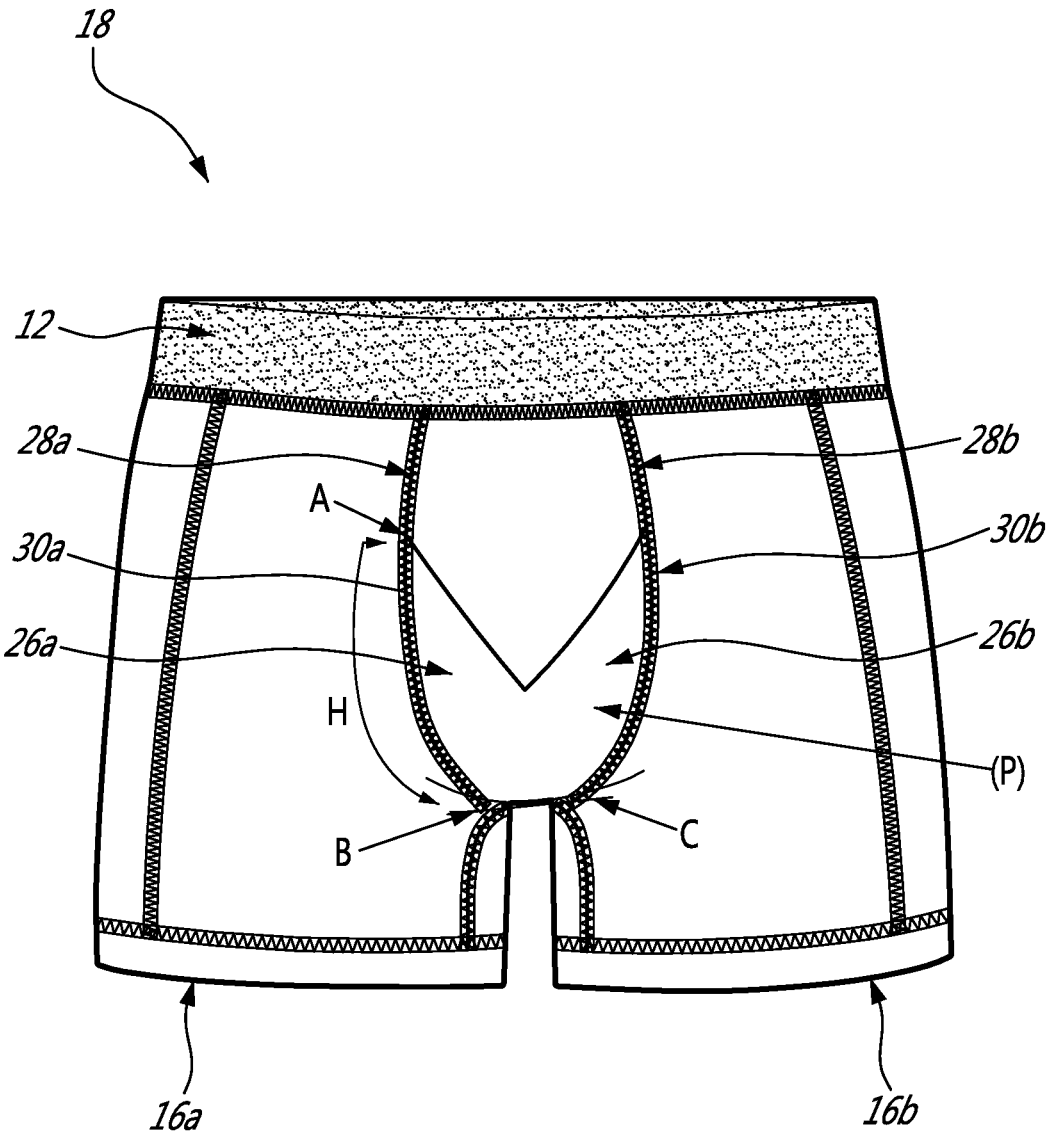
FIG. 3A shows the inside of a front portion of a garment according to another embodiment of the present invention.

A garment 10 according to an embodiment of the invention is illustrated for example in FIGS. 1 to 3.

The garment 10 as illustrated comprises a waist band 12 and a body 14. The body 14 comprises a front portion 18 and a back portion 20 and extends into leg openings 16*a* and 16*b*.

As illustrated in FIGS. 1 and 2, the front portion 18 comprises a left flap 26*a* and a right flap 26*b*. Each flap is of a generally triangular shape, with a generally vertical side 30*a*, 30*b* i.e. generally perpendicular to the top edge of the front portion 18, i.e. generally perpendicular to the waist band 12, a generally horizontal side 34*a*, 34*b* (only one generally horizontal side 34*a* is seen in in FIG. 1), i.e. to the top edge of the front portion 18, i.e. generally parallel to the waist band 12, and an oblique side 32*a*, 32*b* connecting a top end of the vertical side 30*a*, 30*b* and a free end of the horizontal side 34*a*.

Each flap is connected to the material 24 of the front portion 18, on the inner side of the front portion 18, i.e. inside of the garment 10, with the vertical side 30*a*, 30*b* (see A-B in FIG. 2 showing flap 26*a*) connected, by sewing for example, to a seam 28*a*, 28*b* and the horizontal side 34*a*, 34*b* along a bottom seam 40 of the front portion 18 (see B-C in FIG. 2).

The height of each flap, i.e. the height of the generally vertical sides 30*a*, 30*b* is about two thirds of the height of the seam 28*a*, 28*b* from the bottom seam 40 of the front portion 18 to the waist band 12 as shown in FIG. 2.

Thus the two flaps 26*a* and 26*b* cross at their bottom, on about a third (h) of their height (H) from the bottom seam 40 of the front portion 18 as shown in FIG. 2. They thus form a pouch (P) in the center of the front portion on the inside of the front portion 18 of the garment 10, with a wide top opening aligned with the genitals of the wearer as the wearer inserts his legs through the leg openings 16*a* and 16*b*.

Figure 3B:
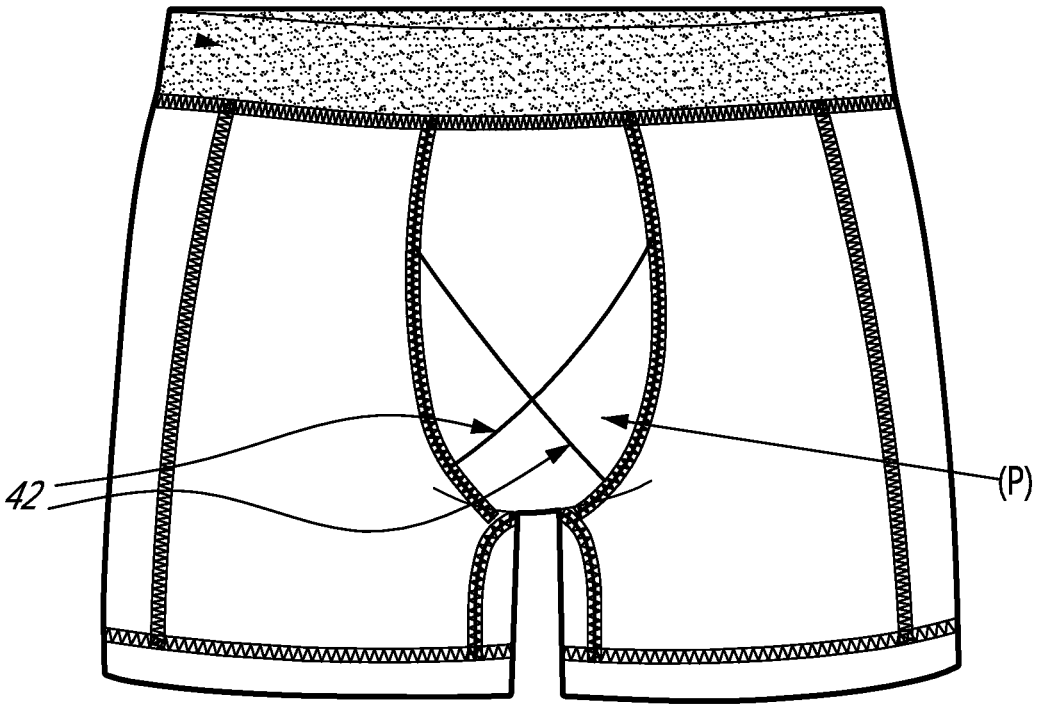
FIG. 3B shows the inside of a front portion of a garment according to still another embodiment of the present invention.

In the embodiments illustrated in FIG. 3, the two flaps of the pouch (P) on the inside of the front portion 18 of the garment are formed in a single piece of material. In the detail shown in FIG. 3B, flatlock stitches 42 for example may provide a crossed pattern at the bottom of the pouch (P).

Such a pouch comprising a crossed-patterned bottom opposite its top opening provides a sleek support and smooth shaping for the genitals of the wearer.

The present garment provides increased comfort as the genitals are maintained within the pouch without contact with the inside of the thighs, while allowing movement if required when practicing a sport for example.

The present garment or part thereof may be made in a range of materials, including for example bamboo, rayon and combination thereof, viscose, viscose elastane, acrylic, polyester, micromodal fibers, mesh, microfibers, Tactel™, organza, silk, satin, CoolMax™, elastane fiber such as Spandex™, cotton, polycotton, combed cotton, ringspun cotton, Supima cotton, organic cotton, cotton elastane etc. . . . and combination thereof. For example, the pouch, i.e. the two flaps 26*a* and 26*b*, may be made in mesh, while the remaining of the garment may be in cotton.

The present combination of flaps may be used on a range of men's garments, such as briefs, underwear, shorts, leggings, swimming suits, long underwear, base layers, cycling shorts, and thermal base layers for example.

The scope of the claims should not be limited by the embodiments set forth in the examples, but should be given the broadest interpretation consistent with the description as a whole.

The invention claimed is:

1. A male garment, comprising a waist band and a body, said body comprising a front portion and a back portion extending into leg openings at a bottom edge thereof, wherein said front portion comprises, on an inner side thereof, a left flap and a right flap;

wherein each flap is of a generally triangular shape, with a first side generally parallel to a top edge of the front portion and parallel to the waist band, a second side generally perpendicular to the top edge of the front portion and perpendicular to the waist band and an oblique side connecting a top end of said second side and a free end of said first side, each flap being connected to the front portion, on the inner side of the front portion inside of the garment, with said second side of each flap connected to a vertical seam of the front portion and said first side of each flap connected along a bottom seam of the front portion; and wherein a height of the second side of each flap is two thirds of a height of the vertical seam of the front portion from the bottom seam of the front portion to the waist band, so that the two flaps cross at a bottom thereof, at a center of the front portion, on a third of a height thereof from said bottom seam of the front portion, and form a pouch in the center of the front portion on the inside of the front portion of the garment, with a wide top opening configured for alignment with genitals of a wearer as the wearer inserts his legs through the leg openings, said pouch having a crossed-patterned bottom opposite the wide top opening configured to support the genitals of the wearer when the user wears the garment.

2. The male garment of claim 1, wherein said flaps are formed in a single piece of material.

3. The male garment of claim 1, wherein flatlock stitches provide a crossed pattern at the bottom of the pouch.

4. The male garment of claim 1, made in at least one of: bamboo, rayon and combination thereof, viscose, viscose elastane, acrylic, polyester, micromodal fibers, mesh, microfibers, organza, silk, satin, elastane fiber such as spandex, cotton, polycotton, combed cotton, ringspun cotton, supima-cotton, organic cotton, cotton elastane and combination thereof.

5. The male garment of claim 1, wherein said flaps are made in mesh.

6. The male garment of claim 1, wherein said male garment is a base layer.

7. A male garment, comprising a waist band and a body, said body comprising a front portion and a back portion extending into leg openings at a bottom edge thereof, wherein said front portion comprises a pouch in the center thereof, said pouch having a top opening configured to align with genitals of a user as the user inserts his legs through the leg openings, and a crossed-patterned bottom, opposite said top opening, configured to support the genitals of the user when the user wears the garment;

wherein said pouch is formed of a left flap and a right flap crossing at a bottom thereof, at the center of the front portion;

wherein each flap is of a generally triangular shape, with a first side generally parallel to a top edge of the front portion and parallel to the waist band, a second side generally perpendicular to the top edge of the front portion and perpendicular to the waist band and an oblique side connecting a top end of said second side and a free end of said first side, each flap being connected to the front portion, on the inner side of the front portion inside of the garment, with said second side of each flap connected to a vertical seam of the front portion and said first side of each flap connected along a bottom seam of the front portion; and wherein a height of the second side of each flap is two thirds of a height of the vertical seam of the front portion from the bottom seam of the front portion to the waist band, so that the two flaps cross at a bottom thereof, on a third of a height thereof from said bottom seam of the front portion and form the pouch in the center of the front portion on the inside of the front portion of the garment.

8. A method for manufacturing a male garment, comprising:

providing a garment body extending from a waist band, the body comprising a front portion and a back portion extending into leg openings;

connecting a left flap of a generally triangular shape, with a first side generally parallel to a top edge of the front portion and parallel to the waist band, a second side generally perpendicular to the top edge of the front portion and perpendicular to the waist band, and an oblique side connecting said first and second sides to the front portion, on an inner side of the front portion; and connecting a right flap of a generally triangular shape, with a first side generally parallel to the top edge of the front portion and parallel to the waist band, a second side generally perpendicular to the top edge of the front portion and perpendicular to the waist band, and an oblique side connecting said first and second sides to the front portion, on the inner side of the front portion, with the second side of each flap connected to a vertical seam of the front portion and the first side of each flap connected along a bottom seam of the front portion, and a height of the second side of each flap being two thirds of a height of the vertical seam of the front portion from the bottom seam of the front portion to the waist band, so that the two flaps cross at a bottom thereof, on a third of a height thereof from said bottom seam of the front portion to the waist band and form a pouch in the center of the front portion on the inside of the front portion of the garment, with a wide top opening, said pouch having a crossed-patterned bottom at a bottom edge of the front portion between the leg openings opposite the wide top opening.

* * * * *